United States Patent [19]

Ettehadieh

[11] Patent Number: 4,844,875

[45] Date of Patent: Jul. 4, 1989

[54] FLY ASH RECYCLING TO REDUCE TOXIC GASEOUS EMISSIONS

[75] Inventor: Bozorg Ettehadieh, Wilkins Twp., Allegheny County, Pa.

[73] Assignee: Westinghouse Electric Corp., Pittsburgh, Pa.

[21] Appl. No.: 107,737

[22] Filed: Oct. 13, 1987

[51] Int. Cl.[4] ..... B01D 53/10; B01D 53/34

[52] U.S. Cl. ..... 423/210; 423/240; 423/245.1; 423/245.3

[58] Field of Search ..... 423/239, 244 A, 240 R, 423/240 S, 245 R, 245 S, 247, 210, 245.1, 245.3

[56] References Cited

U.S. PATENT DOCUMENTS

| | | | |
|---|---|---|---|
| 4,042,667 | 8/1977 | Ishiwata et al. | 423/240 S |
| 4,411,879 | 10/1983 | Ehrlich et al. | 423/244 A |
| 4,654,203 | 3/1987 | Maurer et al. | 423/240 S |
| 4,710,365 | 12/1987 | Gebhard et al. | 423/242 A |

FOREIGN PATENT DOCUMENTS

| | | | |
|---|---|---|---|
| 3339111 | 5/1985 | Fed. Rep. of Germany | 423/245 |

OTHER PUBLICATIONS

Perry's Chemical Engineers' Handbook, 6th ed. Perry et al., eds. McGraw—Hill Book Co. 1984, pp. 20–73, 74.

Article in Chemical & Engineering News, Aug. 27, 1984.

Hasselriis, Refuse Combustion and Effects on Organic Emissions (1986).

*Primary Examiner*—John Doll

*Assistant Examiner*—Jeffrey Edwin Russel

[57] ABSTRACT

A process for removing toxic compounds from gaseous emissions of municipal solid waste combustion systems is disclosed in which fly ash produced by the incineration process is used to adsorb toxins, and is recycled to a combustor, which destroys the adsorbed toxins and regenerates the fly ash for further toxin recovery.

20 Claims, 1 Drawing Sheet

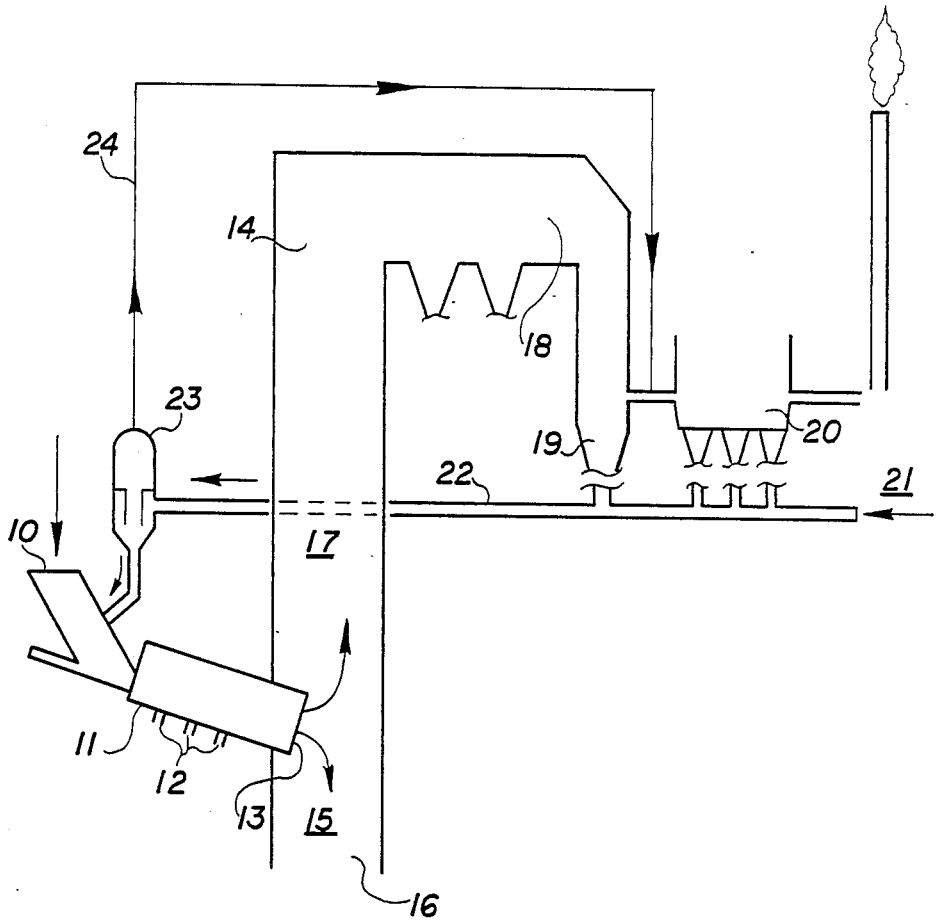
24
14
18
23
19
20
22
21
10
17
11
12
13
15
16

FLY ASH RECYCLING TO REDUCE TOXIC GASEOUS EMISSIONS

FIELD OF THE INVENTION

The present invention relates to a process for reducing toxic gas emissions from municipal solid waste combustors.

BACKGROUND OF THE INVENTION

Recent reports indicate that U.S. cities and towns generate more than 410,000 tons of waste each day. Until recently, most of this municipal solid waste was disposed at landfill dumping sites. However, in more recent years, the number of available landfills has grown smaller as more and more such sites become filled or are closed for violating state and federal environmental laws and for contaminating groundwater supplies.

In an effort to curb the increased environmental pressures caused by minicipal solid waste, recent efforts have focused on resource recovery, namely the incineration of such wastes and recovery of the heat produced thereby. This recovered heat is used to produce steam for heating buildings, running air conditioners, or powering the turbine of an electrical generator.

A serious problem associated with municipal solid waste incinerators is the emission of dioxins and furans during the combustion process. These artificial organic compounds, such as polychlorinated dibenzo-dioxins, and polychlorinated dibenzo-furans, are suspected of causing a wide range of illnesses, from cancer to birth defects. Scrubbers and baghouses have been used to reduce these emissions with some success, but have not completely eliminated the problem. Accordingly, a significant advance in the art would be realized if a more effective method for reducing toxic gaseous emissions from municipal solid waste incinerators were devised.

SUMMARY OF THE INVENTION

In order to reduce the toxic emissions from municipal solid waste incinerators, a new process has been developed in which fly ash produced in the combustion process is passed through a post combustion section having sufficiently cool temperatures to permit adsorption of toxic compounds on the fly ash. At least a portion of this fly ash is then recycled into the combustor, where sufficiently high temperatures destroy toxic compounds adsorbed on the fly ash by breaking such compounds down into harmless constituent elements and other compounds.

Other details, objects and advantages of the invention will become apparent as the following description of the presently preferred embodiments and presently preferred methods of practicing the invention proceeds.

BRIEF DESCRIPTION OF THE DRAWINGS

In the accompanying drawings, the preferred embodiments of the invention and preferred methods of practicing the invention are illustrated in which:

FIG. 1 is a schematic diagram detailing one system useful in carrying out the presently-claimed process.

DETAILED DESCRIPTION OF THE INVENTION

FIG. 1 illustrates a typical arrangement for the incineration of municipal solid waste. As shown, municipal solid waste, typically unprocessed, is fed into an inlet 10, which conveys the waste to a combustor 11. Gas, generally combustion air, is injected along the length of the combustor 11 through gas injection ports 12. The temperature in the combustor is at least 1800° F., and may be as high as 2200° F. The combustor 11 is preferably of the rotary kiln O'Connor type, having water-cooled, perforated walls.

The combustor has three phases, a driving phase, in which much of the moisture in the municipal solid waste is removed, a combustion phase, in which combustion occurs, and a mass/volume reduction phase, in which over 80% reduction of the mass and volume of the municipal solid waste material occurs. The products of the combustion process, i.e. hot flue gases and ashes, leave the combustor at the combustor exit 13 and pass into the radiant boiler 14.

Once in the radiant boiler, the heavier ash particles 15 fall into the lower boiler section 16, and are carried out of the process. The finer ash particles 17, referred to herein as fly ash, are carried up by the flue gas stream into the post combustion sections 18, 19 and 20. Section 18 is typically the superheater and the convective boiler sections. Section 19 is typically a combustion air preheater or economizer, and section 20 is typically a dry gas scrubber, a bag filter and/or electrostatic precipitator.

Toxic compounds such as dioxins and furans are adsorbed on the fly ash, both by physical adsorption and chemisorption, in these post combustion sections, provided the temperature in these sections is sufficiently cool, generally below 752° F.. More toxin per unit weight of fly ash is adsorbed on the finer fly ash particles, as these have a greater surface area per unit weight than the larger particles.

It has been determined that once these toxic compounds are adsorbed on the fly ash, the compounds are extremely resistant to leaching from the ash, absent other chemical reactions. For example, it has been estimated that 99% of the dioxin adsorbed onto fly ash will be retained by the fly ash 6.5 million years later. However, if certain chemicals are present, the toxic compounds that are adsorbed can be caused to leach from the ash.

After the fly ash passes through the post combustion sections and toxic compounds are adsorbed by the ash particles, at least a portion of ash is recycled to the combustor, and the remaining non-recycled portion is purged from the system. This recycling and purging may be accomplished by a number of commercially available mass transfer means, but pneumatic transport lines or mechanical transport systems have proven effective. The system illustrated in FIG. 1 uses transport gas 21 to convey the ash collected from sections 18, 19 and 20 through an ash transport line 22. This conveyed ash is preferably fed to a cyclone separator 23, which separates the transport gas and feeds the ash to the combustor 11. The cyclone separator preferably has a gas transport line 24 which allows the outgoing gas from the cyclone to be recycled to the post combustion sections.

Once in the combustor, the extremely high combustor temperatures, greater than 1800° F., are effective in desorbing and destroying toxic compounds adhering to the recycled fly ash by breaking such compounds down into harmless constituent elements and other compounds, such as $CO_2$ and water. Other elements, such as chlorine, are removed by a scrubber system. Once the fly ash particles are cleansed of adherent toxic compounds in this way, the recycled fly ash may make another pass through the system to adsorb yet more toxic compounds, which are again recycled to the combustor for destruction. Except for the portion of fly ash which is purged from the system, the fly ash theoretically can make an infinite number of passes through the system, adsorbing toxic compounds, carrying them to the combustor for destruction and regeneration of the adsorbing capability of the fly ash, and passing through the colder sections of the system for further adsorption of toxic compounds.

The ratio of recycled to purged fly ash and the feed rate of recycled ash may be optimized to meet the requirements of a particular system and the degree of toxic removal required. Although the purged fly ash can be withdrawn at any point in the system, it is preferable to withdraw the ash from the process at a point where the removed ash is relatively free of toxins. In this way, ideally more toxic compounds are destroyed in the combustor and less are purged from the system adsorbed to the fly ash. For this reason it is preferred to withdraw the purge stream of the fly ash from the hottest portion of the combustor, where the likelihood that toxic compounds have not been adsorbed by, or have been desorbed from, the fly ash and destroyed is greatest.

Although the invention has been described in detail in the foregoing for the purpose of illustration, it is to be understood that such detail is solely for that purpose and that variations can be made therein by those skilled in the art without departing from the spirit and scope of the invention as described by the claims.

I claim:

1. A process for destroying toxic compounds contained in combustion gas streams comprising;

a. placing combustion material in a combustor;

b. burning said combustion material at a temperature sufficient to destroy toxic compounds and produce fly ash;

c. passing the fly ash produced by burning said combustion material in said combustor through a post combustion section having a sufficiently cool temperature to permit adsorption and chemisorption of toxic compounds by said fly ash;

d. recovering said fly ash from said post combustion section after toxic compounds have been adsorbed by said fly ash;

e. recycling at least a portion of said recovered fly ash, injecting said recycled portion into the combustor, and purging the non-recycled portion, said combustor including a region wherein the temperature is sufficiently high to inhibit adsorption of and destroy toxic compounds on the fly ash, and the non-recycled portion of fly ash is purged from the process in this region;

f. destroying toxic compounds contained on said recycled fly ash in said combustor.

2. The process according to claim 1 wherein said combustion material is municipal solid waste.

3. The process according to claim 1 wherein said combustor is a water-cooled, perforated, rotary kiln.

4. The process according to claim 1 wherein said combustor temperature is at least 1800° F.

5. The process according to claim 1 wherein said post combustion section operates at a temperature below 752° F.

6. A process for destroying toxic compounds contained in combustion gas streams comprising;

a. placing municipal solid waste in a combustor, said combustor comprising a water-cooled, perforated, rotary kiln;

b. burning said combustion material at a temperature sufficient to destroy toxic compounds and produce fly ash, said temperature being at least 1800° F.;

c. passing the fly ash produced by burning said combustion material in said combustor through a post combustion section having a sufficiently cool temperature to permit adsorption and chemisorption of toxic compounds by said fly ash, said temperature in said post combustion section being below 752° F.;

d. recovering said fly ash from said post combustion section after toxic compounds have been adsorbed by said fly ash;

e. recycling at least a portion of said recovered fly ash, injecting said recycled portion into the combustor, and purging the non-recycled portion, said combustor including a region wherein the temperature is sufficiently high to inhibit adsorption of and destroy toxic compounds on the fly ash, and the non-recycled portion of fly ash is purged from the process in this region;

f. destroying toxic compounds contained on said recycled fly ash in said combustor.

7. The process of claim 6 wherein said combustor has a drying phase, a combustion phase, and a mass/volume reduction phase.

8. The process of claim 6 wherein said post combustion section comprises a superheater of a radiant boiler.

9. The processof claim 6 wherein said post combustion section comprises a convective boiler section of a radiant boiler.

10. The process of claim 6 wherein said post combustion section comprises a combustion air preheater.

11. The process of claim 6 wherein said post combustion section comprises an economizer.

12. The process of claim 6 wherein said post combustion section comprises a dry gas scrubber.

13. The process of claim 6 wherein said post combustion section comprises a bag filter.

14. The process of claim 6 wherein said post combustion section comprises an electrostatic precipitator.

15. The process of claim 6 wherein said destroyed toxic compounds are broken down into constituent elements and other compounds, said constituent elements including chlorine and said other compounds including carbon dioxide and water, and said chlorine is removed by a scrubber system.

16. A process for destroying toxic compounds contained in combustion gas streams comprising:

a. placing combustion material in a combustor, said combustion material comprising municipal solid waste;

b. burning said combustion material at a temperature sufficient to destroy toxic compounds and produce fly ash;

c. passing the fly ash produced by burning said combustion material in said combustor through a post combustion section having a sufficiently cool temperature to permit adsorption and chemisorption of toxic compounds by said fly ash;

d. recovering said fly ash from said post combustion section after toxic compounds have been adsorbed by said fly ash;

e. recycling at least a portion of said recovered fly ash, injecting said recycled portion into the combustor, and purging the non-recycled portion;

f. desorbing toxic compounds from said recycled fly ash and destroying said toxic compounds in said combustor.

17. The process according to claim 16 wherein said combustor temperature is at least 1800° F..

18. The process according to claim 17 wherein said post combustion section operates at a temperature below 752° F.

19. The process according to claim 18 wherein said combustor includes a region wherein the temperature is sufficiently high to inhibit adsorption of and destroy toxic compounds on the fly ash, and the non-recycled portion of fly ash is purged from the process in ths region.

20. The process according to claim 16 wherein said combustor is a water-cooled, perforated, rotary kiln.

* * * * *